US007543403B1

(12) United States Patent
Schaefer

(10) Patent No.: US 7,543,403 B1
(45) Date of Patent: Jun. 9, 2009

(54) FIREARM MAGAZINE SAFETY LOCK

(76) Inventor: Ryan T. Schaefer, 22412 Bea Ct., Saugus, CA (US) 91350

( * ) Notice: Subject to any disclaimer, the term of this patent is extended or adjusted under 35 U.S.C. 154(b) by 378 days.

(21) Appl. No.: 11/489,204

(22) Filed: Jul. 19, 2006

(51) Int. Cl.
*F41A 17/38* (2006.01)
*F41A 17/02* (2006.01)

(52) U.S. Cl. ..... 42/70.02; 42/70.11

(58) Field of Classification Search ..... 42/70.01, 42/70.02, 70.11
See application file for complete search history.

(56) References Cited

U.S. PATENT DOCUMENTS

| | | | | | |
|---|---|---|---|---|---|
| 4,261,127 | A | * | 4/1981 | Karkkainen | 42/70.11 |
| D260,548 | S | | 9/1981 | Holland | |
| 4,384,420 | A | * | 5/1983 | Von Muller | 42/70.11 |
| 4,532,729 | A | | 8/1985 | Von Muller | |
| 4,619,062 | A | * | 10/1986 | Johnson | 42/70.11 |
| 4,654,992 | A | | 4/1987 | Lavergne | |
| 4,761,906 | A | * | 8/1988 | Guevara | 42/70.11 |
| 5,081,779 | A | * | 1/1992 | Pack | 42/70.11 |
| 5,361,525 | A | | 11/1994 | Bowes | |
| 5,419,069 | A | | 5/1995 | Mumbleau et al. | |
| 5,465,519 | A | * | 11/1995 | Blanck | 42/70.11 |
| 5,782,029 | A | * | 7/1998 | Brooks | 42/70.11 |
| 5,974,717 | A | * | 11/1999 | Brooks | 42/70.11 |
| 5,987,796 | A | * | 11/1999 | Brooks | 42/70.11 |
| 6,256,919 | B1 | * | 7/2001 | Brazeau | 42/70.11 |
| 6,412,207 | B1 | * | 7/2002 | Crye et al. | 42/70.06 |
| 6,499,244 | B1 | | 12/2002 | Smith et al. | |
| 6,510,639 | B2 | * | 1/2003 | McMoore | 42/70.06 |
| 6,543,170 | B2 | * | 4/2003 | Beretta | 42/70.08 |
| 7,051,468 | B2 | * | 5/2006 | Glock | 42/70.06 |
| 7,222,450 | B2 | * | 5/2007 | Cuprin et al. | 42/70.11 |

* cited by examiner

*Primary Examiner*—Bret Hayes

(57) ABSTRACT

A firearm magazine safety lock for insuring that no ammunition is in the magazine or chamber that has a firearm magazine housing with a generally parallelepiped shape. The firearm magazine housing has two opposite ends, a bottom end and a chamber end. A lock is rotatably connected to the firearm magazine housing bottom end and is disposed within the firearm magazine housing. A slide block is drivingly connected to the lock. The slide block is rotatably connected to the firearm magazine housing chamber end. The slide block is for blocking a slide ejection port of the firearm from within a chamber of the firearm.

16 Claims, 3 Drawing Sheets

FIREARM MAGAZINE SAFETY LOCK

BACKGROUND OF THE INVENTION

1. Field of the Invention

The present embodiment of the invention relates to a firearm magazine safety lock for use in connection with firearm locks. The firearm magazine safety lock has particular utility in connection with firearm magazine safety locks that prevent a cartridge from being in the firearm.

2. Description of the Prior Art

Firearm magazine safety locks are desirable for safely transporting and storing a firearm. The unintentional firing of a firearm kills many people yearly. A need was felt for a firearm lock that would preclude a round from being in the firearm while locked.

The use of firearm locks is known in the prior art. For example, U.S. Pat. No. 4,532,729 to Von Muller discloses a firearm magazine lock for firearms which have a removable magazine feed, provision is made to insert a key operated safety magazine unit which replaces the existing magazine unit. The safety magazine unit locks itself into the magazine well of the firearm when actuated by a removable key. Locking of the safety magazine unit prevents its removal from the magazine well of the firearm and replacement by a magazine with live ammunition. Locking of the safety magazine unit also immobilizes the firing mechanism of the firearm. Immobilization results from an internal blocking of the breech or bolt action necessary for the weapon to be opened or fired. Installation of a safety magazine unit completely immobilizes the firearm preventing its unauthorized firing. The safety magazine unit does not interfere with any of the weapon's inherent safety features. However, the Von Muller '729 patent does not have a locking mechanism which is placed in a firearm as a standard magazine and has a lock that extends into the chamber to prevent the loading of a round.

Similarly, U.S. Pat. No. 5,419,069 to Mumbleau et al. discloses a firearm locking mechanism comprising a block or body having a conventional pin-tumbler or cylindrical lock mounted generally vertically therein. The block or body is received within the exposed area between the breech and open breechblock in a firearm directly above the magazine, with an engagement member connected to the bottom of the lock being received within the top of the magazine and rotated by the lock. The engagement member engages beneath and between the cartridge-retaining surfaces at the top of the magazine to secure the lock and body to the top of the magazine, thereby preventing the breech block from closing or the magazine from being removed. The locking mechanism similarly prevents moving the firing pin assembly into proximity with any cartridge remaining in the barrel or magazine. However, the Mumbleau et al. '069 patent does not have a locking mechanism that is placed in a firearm as a standard magazine and has a lock that extends into the chamber to prevent the loading of a round.

Likewise, U.S. Pat. No. 5,361,525 to Bowes discloses a gun safety lock employs a barrel key to enable the firing mechanism of the gun. The barrel key is inserted in the handle of the gun to allow the hammer of the weapon to be moved into a cocked or firing position. The barrel key is unique for each gun. The barrel key is held in the gun by retaining lugs. A lanyard attaches to the barrel key on one end and to the owner of the gun on the other end. Pressure on the lanyard causes the key to pull out of the gun and thereby disables the gun. However, the Bowes '525 patent does not have a locking mechanism that is placed in a firearm as a standard magazine and has a lock that extends into the chamber to prevent the loading of a round.

Correspondingly, U.S. Pat. No. 6,499,244 to Smith et al. discloses a firearm safety lock for positioning in the chamber of a firearm and preventing the firing of the firearm until the device is removed from the chamber. The firearm safety lock includes an elongate housing for positioning in a chamber of a firearm, and having a longitudinal axis extending between the opposite first and second ends. The housing has an interior and the second end thereof has an opening. A first end member is mounted on and protrudes from the first end of the housing. A lock channel extends from the housing. A second end member is mounted on the second end of the housing. The second end member is slidably mounted in the interior of the housing. The second end member has a retracted position wherein the second end member is generally retracted into the interior of the housing and an extended position wherein the second locating member is generally extended from the second end of the housing for engaging a second end of the chamber of the firearm to lodge the housing in the chamber and preclude removal of the housing from the chamber. A locking mechanism is provided for moving the second end member between the retracted and extended positions. The first end member has a substantially frusta-conical portion for centering the first end member in a first end of the chamber of the firearm and wherein the second end member has a substantially frusta-conical portion formed on the second end of the body member for centering the second end member in the second end of the chamber of the firearm. However, the Smith et al. '244 patent does not have a locking mechanism which is placed in a firearm as a standard magazine and has a lock that extends into the chamber to prevent the loading of a round.

Further, U.S. Pat. No. 4,654,992 to Lavergne discloses a firearm safety device for preventing unauthorized use of an automatic or semi-automatic hand-held fire-arm, such as a shotgun, rifle or revolver, and of the type in which the loading chamber is provided with a lateral opening. The safety device comprises a metallic U-shape frame adapted to surround the underside and lateral sides of the loading chamber. A key-operated lock causes a frame-carried stop member to enter the loading chamber through the lateral opening to secure the device to the gun and to block access to both the magazine and the breech or firing chamber of the fire-arm to prevent magazine loading and passage of bullets or cartridges from the magazine to the breech. The frame also prevents operation of the loading mechanism. However, the Lavergne '992 patent does not have a locking mechanism that is placed in a firearm as a standard magazine and has a lock that extends into the chamber to prevent the loading of a round.

Lastly, U.S. Pat. No. Des. 260,548 to Holland discloses a safety lock for hand gun. However, the Holland '548 patent does not have a locking mechanism that is placed in a firearm as a standard magazine and has a lock that extends into the chamber to prevent the loading of a round.

While the above-described devices fulfill their respective, particular objectives and requirements, the aforementioned patents do not describe a firearm magazine safety lock that allows firearm magazine safety locks that prevent a cartridge from being in the firearm. The Von Muller '729, Mumbleau et al. '069, Bowes '525, Smith et al. '244, Lavergne '992 and Holland '548 patents make no provision for a locking mechanism which is placed in a firearm as a standard magazine and has a lock that extends into the chamber to prevent the loading of a round.

Therefore, a need exists for a new and improved firearm magazine safety lock which can be used for firearm magazine safety locks that prevent a cartridge from being in the firearm. In this regard, the present embodiment of the invention substantially fulfills this need. In this respect, the firearm magazine safety lock according to the present embodiment of the invention substantially departs from the conventional concepts and designs of the prior art, and in doing so provides an apparatus primarily developed for the purpose of firearm magazine safety locks that prevent a cartridge from being in the firearm.

SUMMARY OF THE INVENTION

In view of the foregoing disadvantages inherent in the known types of firearm locks now present in the prior art, the present embodiment of the invention provides an improved firearm magazine safety lock, and overcomes the above-mentioned disadvantages and drawbacks of the prior art. As such, the general purpose of the present embodiment of the invention, which will be described subsequently in greater detail, is to provide a new and improved firearm magazine safety lock and method which has all the advantages of the prior art mentioned heretofore and many novel features that result in a firearm magazine safety lock which is not anticipated, rendered obvious, suggested, or even implied by the prior art, either alone or in any combination thereof.

To attain this, the present embodiment of the invention essentially comprises a firearm magazine housing having generally a parallelepiped shape. The firearm magazine housing has two opposite ends, a bottom end and a chamber end. A lock is rotatably connected to the firearm magazine housing bottom end and is disposed within the firearm magazine housing. A slide block is drivingly connected to the lock. The slide block is rotatably connected to the firearm magazine housing chamber end. The slide block is for blocking a slide ejection port of the firearm from within a chamber of the firearm.

There has thus been outlined, rather broadly, the more important features of the embodiment of the invention in order that the detailed description thereof that follows may be better understood and in order that the present contribution to the art may be better appreciated.

The present embodiment of the invention may also include a rotating shaft and a universal joint. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved firearm magazine safety lock that has all of the advantages of the prior art firearm locks and none of the disadvantages.

It is another object of the present embodiment of the invention to provide a new and improved firearm magazine safety lock that may be easily and efficiently manufactured and marketed.

An even further object of the present embodiment of the invention is to provide a new and improved firearm magazine safety lock that has a low cost of manufacture with regard to both materials and labor, and which accordingly is then susceptible of low prices of sale to the consuming public, thereby making such firearm magazine safety lock economically available to the buying public.

Still another object of the present embodiment of the invention is to provide a new firearm magazine safety lock that provides in the apparatuses and methods of the prior art some of the advantages thereof, while simultaneously overcoming some of the disadvantages normally associated therewith.

Even still another object of the present embodiment of the invention is to provide a firearm magazine safety lock for firearm magazine safety locks that prevent a cartridge from being in the firearm.

Lastly, it is an object of the present embodiment of the invention is to provide a firearm magazine safety lock that has the lock within the magazine to allow normal storage.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
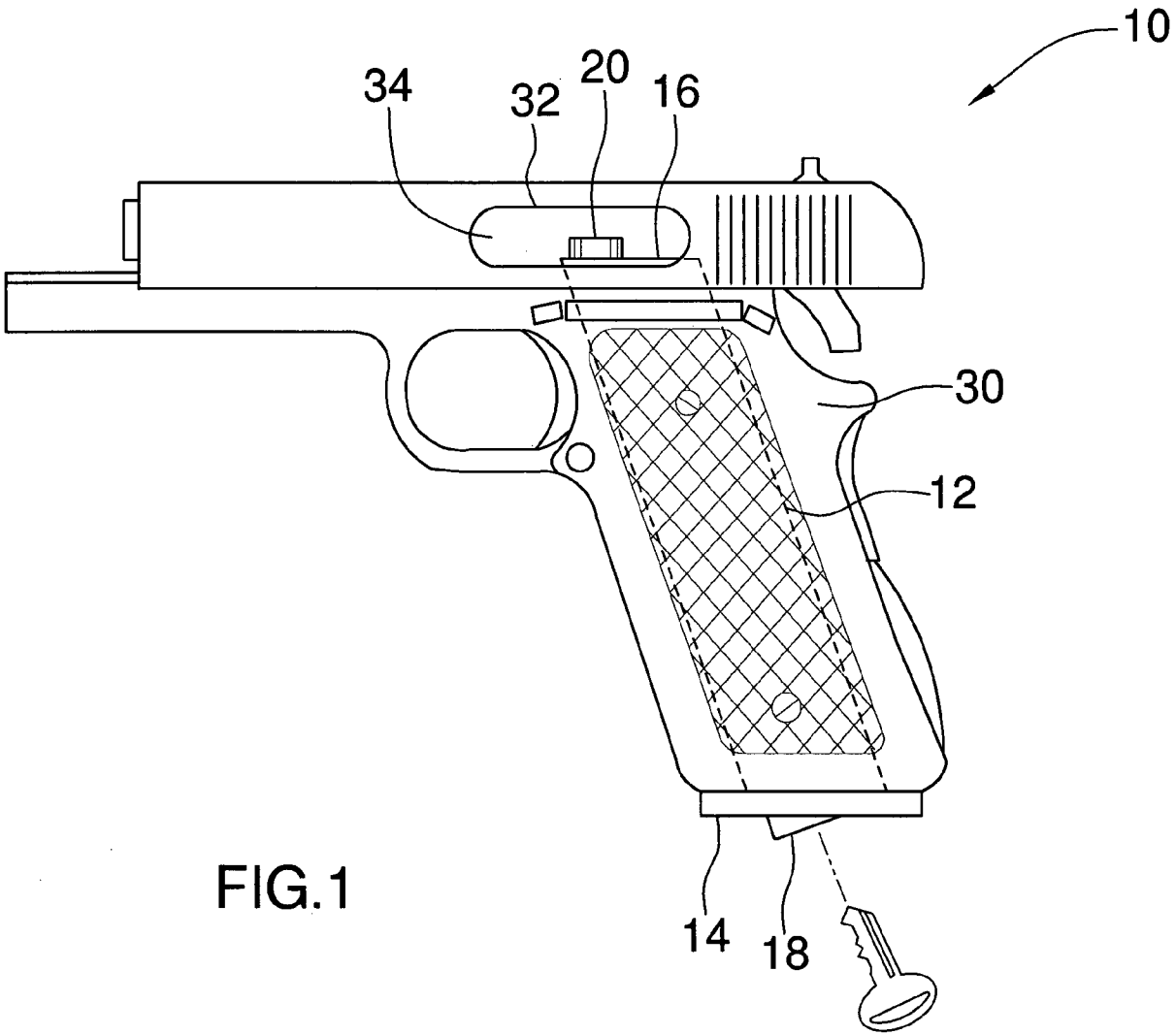
FIG. 1 is a right side view of the preferred embodiment of the firearm magazine safety lock constructed in accordance with the principles of the present invention.

Referring now to the drawings, and particularly to FIGS. 1-5, a preferred embodiment of the firearm magazine safety lock of the present invention is shown and generally designated by the reference numeral 10.

In FIG. 1, a new and improved firearm magazine safety lock 10 of the present invention for firearm magazine safety locks that prevent a cartridge from being in the firearm is illustrated and will be described. More particularly, the firearm magazine safety lock 10 has a firearm magazine housing 12 that has generally the parallelepiped shape. The firearm magazine housing 12 has two opposite ends, a bottom end 14 and a chamber end 16. The firearm magazine housing 12 is comprised of steel. A lock 18 is rotatably connected to the firearm magazine housing bottom end 14. The lock 18 is the cylinder lock. It is critical that the lock 18 is disposed within the firearm magazine housing 12 for allowing a firearm 30 to be stored with the firearm magazine safety lock 10 in the same conditions as without the firearm magazine safety lock 10. The lock 18 is comprised of steel. A slide block 20 is drivingly connected to the lock 18. The slide block 20 is rotatably connected to the firearm magazine housing chamber end 16. The slide block 20 is for blocking a slide ejection port 32 of the firearm 30 from within a chamber 34 of the firearm 30. The slide block 20 has two opposite ends, a pivot end 22 (shown in FIG. 4) drivingly connected to the lock 18 and a blocking end 24 (shown in FIG. 4). The slide block blocking end 24 has the arcuate shape. The slide block pivot end 22 has the arcuate shape. The slide block 20 is comprised of steel. A rotating shaft 26 (shown in FIG. 5) is connected to the lock 18. A universal joint 28 (shown in FIG. 5) is connected to the slide block 20.

Figure 2:
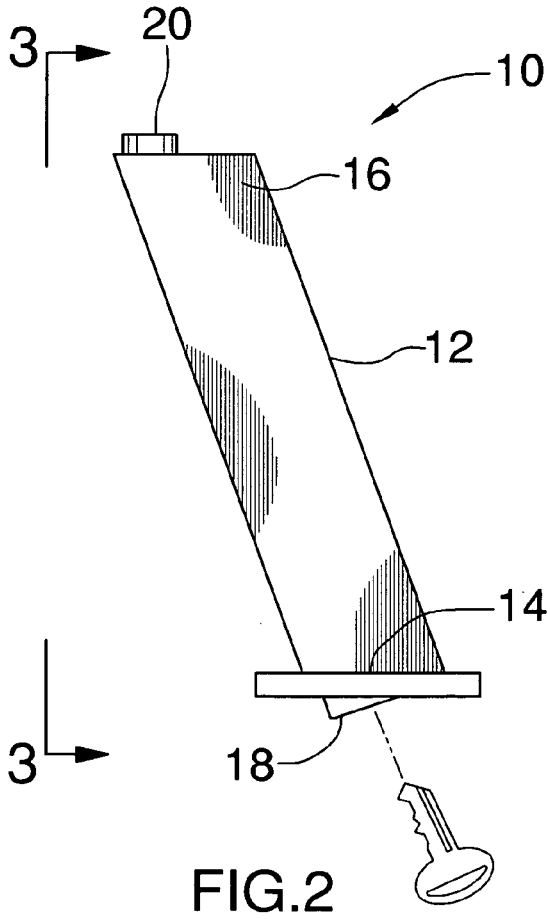
FIG. 2 is a right side view of the firearm magazine safety lock of the present embodiment of the invention.

In FIG. 2, the firearm magazine safety lock 10 is illustrated and will be described. More particularly, the firearm magazine safety lock 10 has the firearm magazine housing 12 that has generally the parallelepiped shape. The firearm magazine housing 12 has two opposite ends, the bottom end 14 and the chamber end 16. The firearm magazine housing 12 is comprised of steel. The lock 18 is rotatably connected to the firearm magazine housing bottom end 14. The lock 18 is the cylinder lock. It is critical that the lock 18 is disposed within the firearm magazine housing 12 for allowing the firearm 30 to be stored with the firearm magazine safety lock 10 in the same conditions as without the firearm magazine safety lock 10. The lock 18 is comprised of steel. The slide block 20 is drivingly connected to the lock 18. The slide block 20 is rotatably connected to the firearm magazine housing chamber end 16. The slide block 20 is for blocking the slide ejection port 32 (shown in FIG. 1) of the firearm 30 (show in FIG. 1) from within the chamber 34 (shown in FIG. 1) of the firearm 30. The slide block 20 is comprised of steel.

Figure 3:
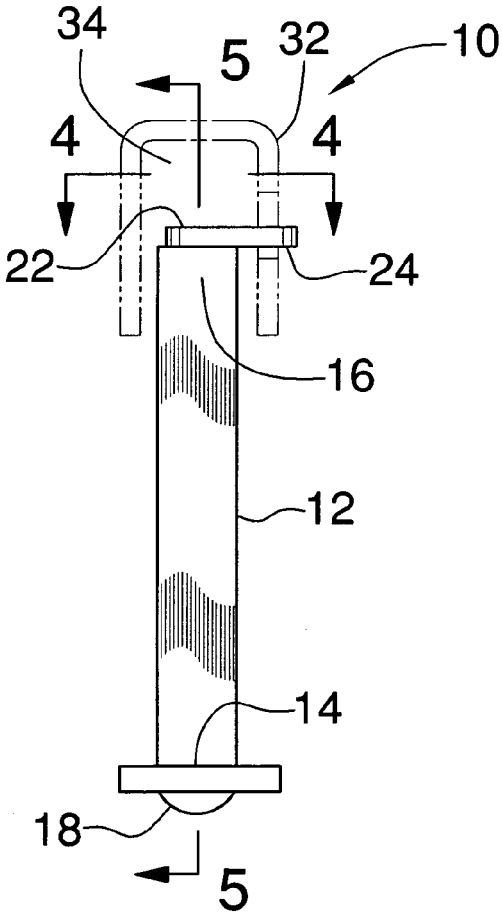
FIG. 3 is a section 3-3 view of FIG. 2 of the firearm magazine safety lock of the present embodiment of the invention.

In FIG. 3, the firearm magazine safety lock 10 is illustrated and will be described. More particularly, the firearm magazine safety lock 10 has the firearm magazine housing 12 that has generally the parallelepiped shape. The firearm magazine housing 12 has two opposite ends, the bottom end 14 and the chamber end 16. The firearm magazine housing 12 is comprised of steel. The lock 18 is rotatably connected to the firearm magazine housing bottom end 14. The lock 18 is the cylinder lock. It is critical that the lock 18 is disposed within the firearm magazine housing 12 for allowing the firearm 30 to be stored with the firearm magazine safety lock 10 in the same conditions as without the firearm magazine safety lock 10. The lock 18 is comprised of steel. The slide block 20 is drivingly connected to the lock 18. The slide block 20 is rotatably connected to the firearm magazine housing chamber end 16. The slide block 20 is for blocking the slide ejection port 32 (shown in FIG. 1) of the firearm 30 (show in FIG. 1) from within the chamber 34 (shown in FIG. 1) of the firearm 30. The slide block 20 has two opposite ends, the pivot end 22 drivingly connected to the lock 18 and the blocking end 24. The slide block 20 is comprised of steel.

Figure 4:
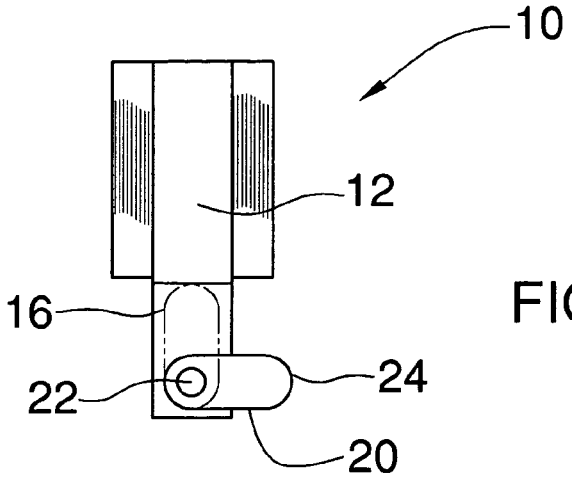
FIG. 4 is a section 4-4 view of FIG. 3 of the firearm magazine safety lock of the present embodiment of the invention.

In FIG. 4, the firearm magazine safety lock 10 is illustrated and will be described. More particularly, the firearm magazine safety lock 10 has the firearm magazine housing 12 that has generally the parallelepiped shape. The firearm magazine housing 12 has two opposite ends, the bottom end 14 and the chamber end 16. The firearm magazine housing 12 is comprised of steel. The slide block 20 is drivingly connected to the lock 18 (shown in FIG. 1). The slide block 20 is rotatably connected to the firearm magazine housing chamber end 16. The slide block 20 is for blocking the slide ejection port 32 (shown in FIG. 1) of the firearm 30 (show in FIG. 1) from within the chamber 34 (shown in FIG. 1) of the firearm 30. The slide block 20 has two opposite ends, the pivot end 22 drivingly connected to the lock 18 and the blocking end 24. The slide block blocking end 24 has the arcuate shape. The slide block pivot end 22 has the arcuate shape. The slide block 20 is comprised of steel.

Figure 5:
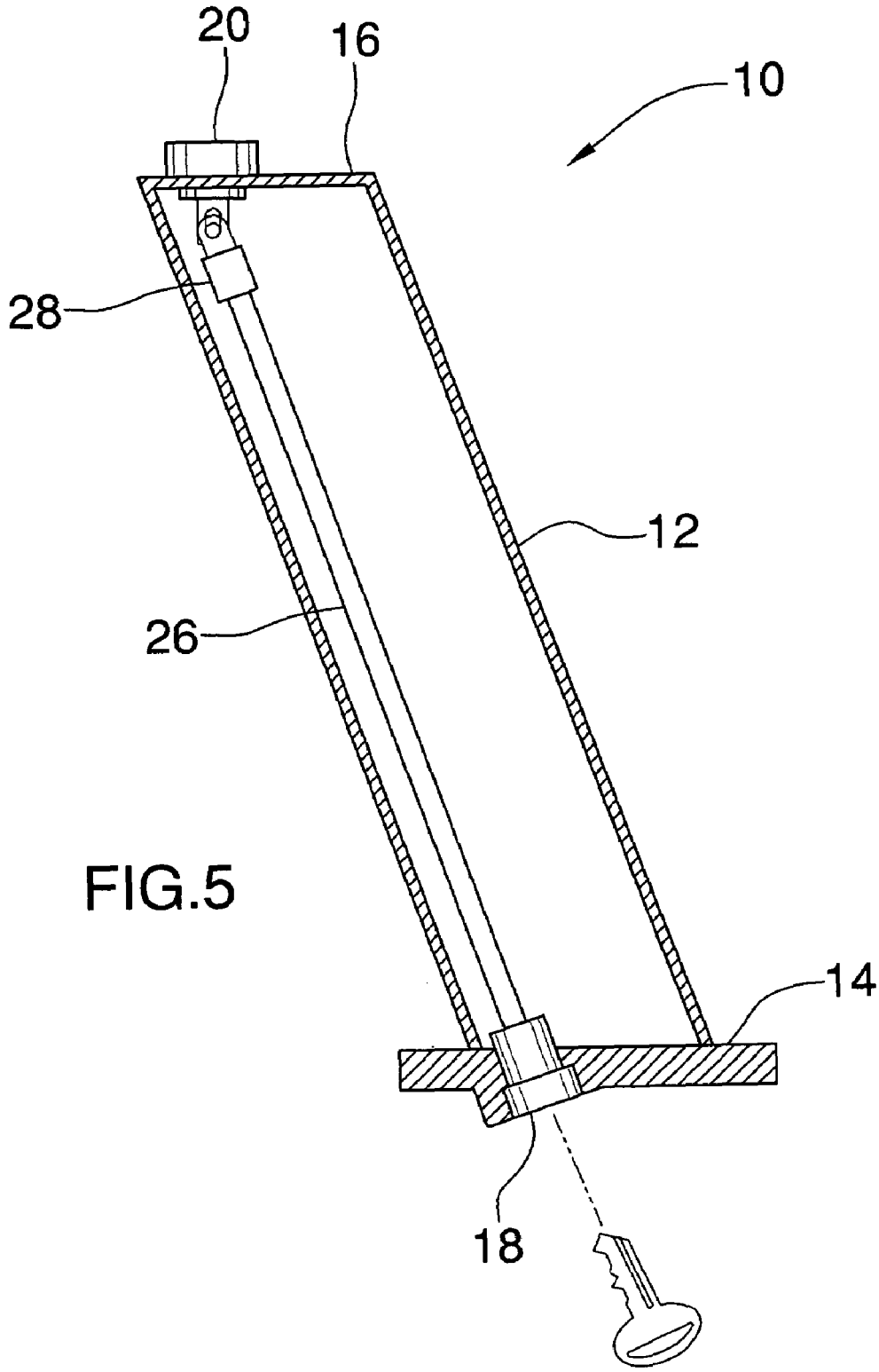
FIG. 5 is a section 5-5 view of FIG. 3 of the firearm magazine safety lock of the present embodiment of the invention.

In FIG. 5, the firearm magazine safety lock 10 is illustrated and will be described. More particularly, the firearm magazine safety lock 10 has the firearm magazine housing 12 that has generally the parallelepiped shape. The firearm magazine housing 12 has two opposite ends, the bottom end 14 and the chamber end 16. The firearm magazine housing 12 is comprised of steel. The lock 18 is rotatably connected to the firearm magazine housing bottom end 14. The lock 18 is the cylinder lock. It is critical that the lock 18 is disposed within the firearm magazine housing 12 for allowing the firearm 30 to be stored with the firearm magazine safety lock 10 in the same conditions as without the firearm magazine safety lock 10. The lock 18 is comprised of steel. The slide block 20 is drivingly connected to the lock 18. The slide block 20 is rotatably connected to the firearm magazine housing chamber end 16. The slide block 20 is for blocking the slide ejection port 32 (shown in FIG. 1) of the firearm 30 (show in FIG. 1) from within the chamber 34 (shown in FIG. 1) of the firearm 30. The slide block 20 is comprised of steel. The rotating shaft 26 is connected to the lock 18. The universal joint 28 is connected to the slide block 20.

In use, it can now be understood that the firearm magazine safety lock 10 is inserted into a firearm 30, the cylinder lock 18 is rotated and locked causing the slide block 20 to block the slide ejection port and render the receiver inoperable. The transverse position of the slide block would also extend over the exterior frame of the weapon to lock it inside the weapon and prevent unauthorized removal. Thus the firearm has no rounds in the magazine or in the chamber and the chamber is blocked from closing.

While a preferred embodiment of the firearm magazine safety lock has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy material such as plastic or composite may be used instead of the steel magazine described. Also, the swing arm may also be made of heavy-duty plastic, composite or steel.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

REFERENCE NUMERALS IN DRAWINGS FOR GDA2523 (SCHAEFER)

10 firearm magazine safety lock
12 firearm magazine housing
14 firearm magazine housing bottom end
16 firearm magazine housing chamber end
18 lock
20 slide block
22 slide block pivot end
24 slide block blocking end
26 rotating shaft
28 universal joint
30 firearm
32 slide ejection port
34 chamber

I claim:

1. A firearm magazine safety lock comprising:

a firearm magazine housing having generally a parallelepiped shape, said firearm magazine housing having two opposite ends, a bottom end and a chamber end;

a lock rotatably connected to said firearm magazine housing bottom end, said lock is disposed within said firearm magazine housing;

a slide block drivingly connected to said lock, said slide block rotatably connected to said firearm magazine housing chamber end, said slide block for blocking a slide ejection port of said firearm from within a chamber of said firearm; and a universal joint connected to said slide block.

2. The firearm magazine safety lock of claim 1 further comprising:

a rotating shaft connected to said lock.

3. The firearm magazine safety lock of claim 1 wherein:

said slide block having two opposite ends, a pivot end and a blocking end, drivingly connected to said lock.

4. The firearm magazine safety lock of claim 3 wherein:

said slide block blocking end having an arcuate shape.

5. The firearm magazine safety lock of claim 3 wherein:

said slide block pivot end having an arcuate shape.

6. The firearm magazine safety lock of claim 1 wherein:

said lock is a cylinder lock.

7. The firearm magazine safety lock of claim 1 wherein:

said firearm magazine housing is comprised of steel; and said lock is comprised of steel.

8. The firearm magazine safety lock of claim 1 wherein:

said slide block is comprised of steel.

9. A firearm magazine safety lock comprising:

a firearm magazine housing having generally a parallelepiped shape, said firearm magazine housing having two opposite ends, a bottom end and a chamber end;

a lock rotatably connected to said firearm magazine housing bottom end, said lock is disposed within said firearm magazine housing;

a slide block drivingly connected to said lock, said slide block rotatably connected to said firearm magazine housing chamber end, said slide block for blocking a slide ejection port of said firearm from within a chamber of said firearm;

a universal joint connected to said slide block; and a rotating shaft connected to said lock.

10. The firearm magazine safety lock of claim 9 wherein:

said slide block having two opposite ends, a pivot end and a blocking end, drivingly connected to said lock.

11. The firearm magazine safety lock of claim 10 wherein:

said slide block blocking end having an arcuate shape.

12. The firearm magazine safety lock of claim 10 wherein:

said slide block pivot end having an arcuate shape.

13. The firearm magazine safety lock of claim 9 wherein:

said lock is a cylinder lock.

14. The firearm magazine safety lock of claim 9 wherein:

said firearm magazine housing is comprised of steel; and said lock is comprised of steel.

15. The firearm magazine safety lock of claim 9 wherein:

said slide block is comprised of steel.

16. A firearm magazine safety lock comprising:

a firearm magazine housing having generally a parallelepiped shape, said firearm magazine housing having two opposite ends, a bottom end and a chamber end, said firearm magazine housing is comprised of steel;

a lock rotatably connected to said firearm magazine housing bottom end, said lock is a cylinder lock, said lock is disposed within said firearm magazine housing, said lock is comprised of steel;

a slide block drivingly connected to said lock, said slide block rotatably connected to said firearm magazine housing chamber end, said slide block for blocking a slide ejection port of said firearm from within a chamber of said firearm, said slide block having two opposite ends, a pivot end drivingly connected to said lock and a blocking end, said slide block blocking end having an arcuate shape, said slide block pivot end having an arcuate shape, said slide block is comprised of steel;

a rotating shaft connected to said lock; and a universal joint connected to said slide block.

* * * * *